US005179415A

United States Patent [19]

Ikematsu et al.

[11] Patent Number: 5,179,415

[45] Date of Patent: Jan. 12, 1993

[54] ELECTRO-PHOTOGRAPHIC PRINTING APPARATUS COMPRISING A TONER FIXING UNIT

[75] Inventors: Hideki Ikematsu; Tetsuya Fujimoto, Kawasaki, both of Japan

[73] Assignee: Fujitsu Limited, Kanagawa, Japan

[21] Appl. No.: 716,986

[22] Filed: Jun. 18, 1991

[30] Foreign Application Priority Data

Jun. 20, 1990 [JP] Japan ..... 2-162026

[51] Int. Cl.[5] ..... G03G 15/20

[52] U.S. Cl. ..... 355/290; 219/216

[58] Field of Search ..... 355/283, 295, 290, 282; 219/216, 469–471

[56] References Cited

U.S. PATENT DOCUMENTS 4,899,197 2/1990 Davis et al. ..... 355/290

4,965,640 10/1990 Watarai et al. ..... 355/283

FOREIGN PATENT DOCUMENTS 0195180 9/1986 European Pat. Off. ..... 355/282

63-293576 11/1988 Japan ..... 355/290

*Primary Examiner*—A. T. Grimley

*Assistant Examiner*—Shuk Y. Lee

*Attorney, Agent, or Firm*—Staas & Halsey

[57] ABSTRACT

A fixing unit of an electro-photographic apparatus having: a heat roller installed on a frame, for fixing a toner image on a sheet; a pressure roller for pinching the sheet with the heat roller; a separator contacting the heat roller, for separating the sheet from the heat roller; a cleaning wiper contacting the heat roller, for cleaning the heat roller; and a sub-frame carrying the pressure roller, the separator and the cleaning wiper, where the sub-frame is hinged by an axle which is installed on the frame, in parallel to the heat roller. The pressure roller, the separator and the cleaning wiper are released all together from the heat roller when the sub-frame is opened by being rotated around the axle. In thus-opened state, the jammed sheet can be easily taken out by operator's finger because the jammed sheet is exposed to thus-provided sufficiently wide space and the sheet is merely sticking to heat roller without being undesirably bitten by separator 16 or by cleaning wiper 17. Moreover, the easy sheet-removal operation prevents the operator's fingers from being burnt by touching the hot heat roller.

2 Claims, 5 Drawing Sheets

ELECTRO-PHOTOGRAPHIC PRINTING APPARATUS COMPRISING A TONER FIXING UNIT

BACKGROUND OF THE INVENTION

1. Field of the Invention

This invention relates to a toner fixing unit employed in, for example, an electro-photographic printing apparatus. More specifically, this invention relates to a fixing unit in which a pressure roller, a sheet-separator and a cleaning wiper, each provided around a developer roller and all integrated in a single sub-frame, can be removed all together from the fixing roller by rotating the sub-frame.

2. Description of the Related Arts

Electro-photographic printing apparatus are typically composed as follows. A laser light modulated by data to be printed is scanned onto a photosensitive drum which has been charged with a high voltage so that a latent image is formed thereon. Developer containing toner is stirred in a toner tank and is electrostatically deposit on the latent image so as to develop a toner image thereon. Then, a sheet is fed on to the toner image so that the toner image is electrostatically transferred onto the sheet from the photosensitive drum. The sheet having the toner image thereon is then input to a fixing unit where the toner is pressed by a heat roller and a press roller to the sheet as well as heated so that the toner is melted thereon, i.e. fixed.

A typical prior art configuration of the fixing unit is schematically illustrated in FIG. 1. Heat roller (i.e. fixing roller) R1, press roller R2, separator 16*a* and cleaning wiper 17*a* are installed on a fixer unit frame 18*a*. On fixer unit frame 18*a* there are an inlet 90 and an outlet 91 through which sheet 12*a* having the toner image thereon is transported to and from rollers R1 and R2. Press roller R2 presses via a spring 81 sheet 12*a* towards the fixing roller R1 having heater lamp 80 therein. Separator 16*a* peels off sheet 12*a* from fixing roller R1. Cleaning wiper 17*a* typically formed of felt wipes off toner remaining on the surface of fixing roller R1.

Another typical prior art configuration is disclosed in Japanese Unexamined Patent Publication Sho 63-293576, where a pressure roller and a separator are installed on a sub-frame hinged onto a frame having fixing roller thereon so that they are removed together from the fixing roller.

It is very general in electro-photographic printing apparatus that the sheet is liable to go into between separator and fixing roller and furthermore between cleaning wiper and fixing roller, where the sheet is jammed, even though separator has been provided in order to remove the sheet from the fixing roller.

Problem of above-cited prior art configurations is in that the operation to remove the jammed sheet is troublesome and time-consuming, because if the sheet pinched under the separator and/or the cleaning wiper is forced to be pulled out the sheet is easily broken and may stay deep in the fixing unit. In removing the jammed sheet the separator is even likely to be broken. Moreover, the manual operation in the narrow space may cause the operator's fingers to get burnt.

SUMMARY OF THE INVENTION

It is a general object of the invention to provide an electro-photographic printing apparatus where a sheet jammed in its fixing unit is easily removed therefrom without breaking the sheet and with less possibility for operator's finger to touch the hot fixing roller.

A fixing unit of the electro-photographic printing apparatus according to the present invention comprises: a heat roller 14 installed on a frame 18, for fixing a toner image on a sheet; a pressure roller 15 for pinching the sheet with the heat roller; a separator 16 contacting the heat roller, for separating the sheet from the heat roller; a cleaning wiper 17 contacting the heat roller, for cleaning the heat roller; and a sub-frame 19 carrying the pressure roller, the separator and the cleaning wiper, where the sub-frame is hinged by an axle which is installed on the frame, in parallel to the heat roller. The pressure roller, the separator and the cleaning wiper are released all together from the heat roller when the sub-frame is opened by being rotated around the axle.

The above-mentioned features and advantages of the present invention, together with other objects and advantages, which will become apparent, will be more fully described hereinafter, with references being made to the accompanying drawings which form a part hereof, wherein like numerals refer to like parts throughout.

A BRIEF DESCRIPTION OF THE DRAWINGS

FIG. 1 schematically illustrates a cross-sectional view of a prior art fixing unit employed in an electro-photographic printing apparatus;

FIG. 2 schematically illustrates a cross-sectional view of a typical electro-photographic printing apparatus;

FIG. 3 illustrates the principle of a fixing unit of the present invention;

FIG. 4 schematically illustrates a cross-sectional view of a closed state of a preferred embodiment of a fixing unit according to the present invention; and FIG. 5 schematically illustrates a cross-sectional view of an opened state of the FIG. 4 fixing unit.

DESCRIPTION OF THE PREFERRED EMBODIMENT

Figure 1:
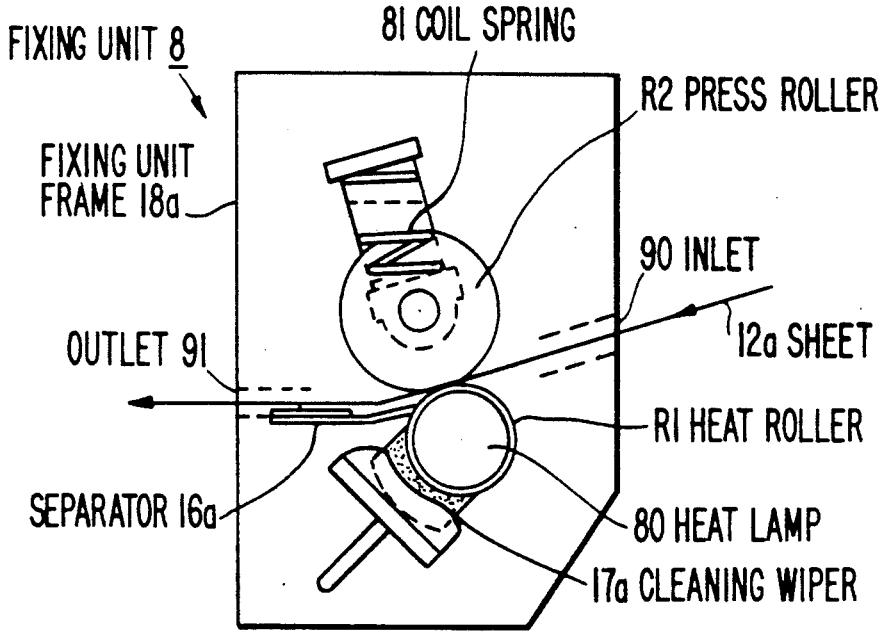
FIG. 1 PRIOR ART
Figure 2:
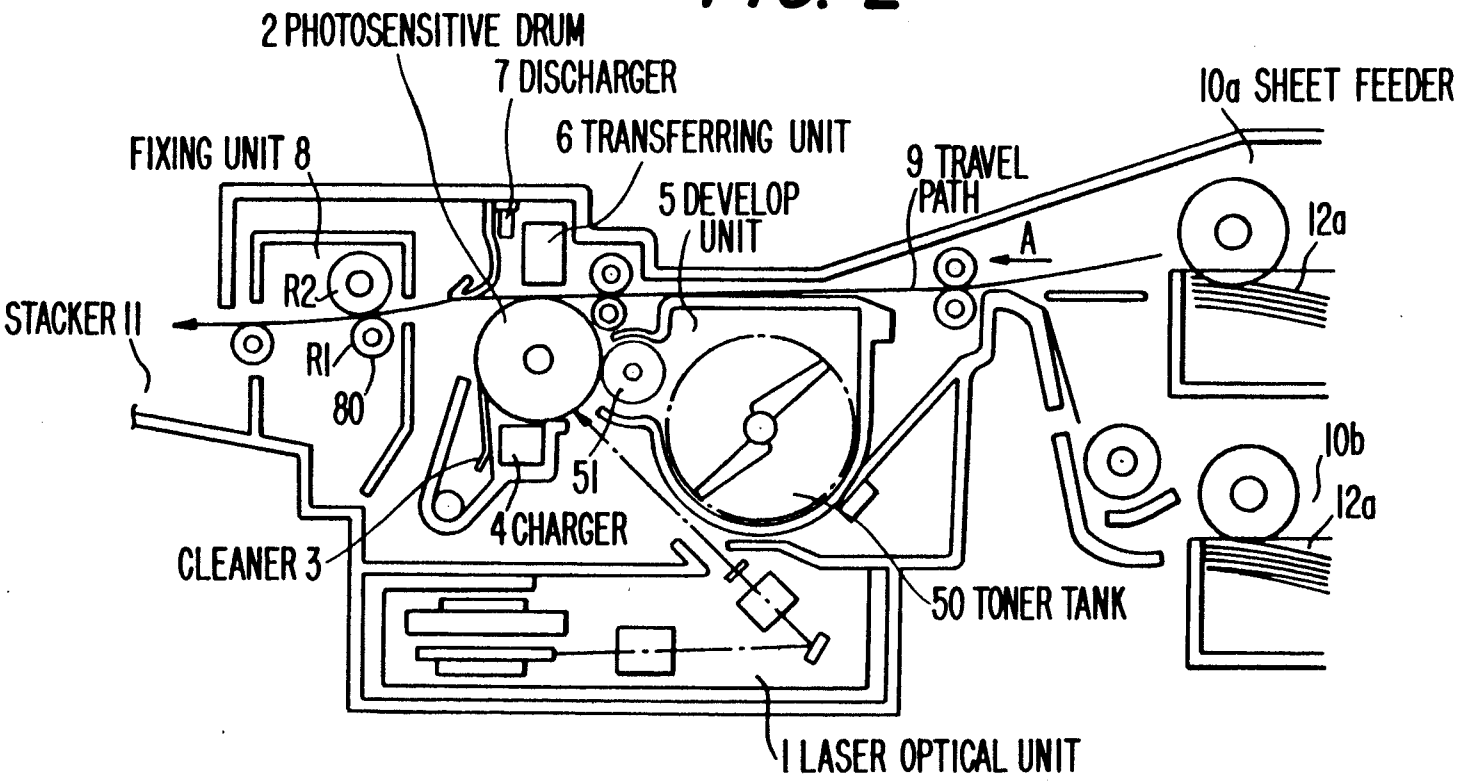

FIG. 2 schematically illustrates a cross-sectional cut view of an electro-photographic printing apparatus which the fixing unit of the present invention is applicable to. The numeral 1 denotes a laser optical unit; the numeral 2 denotes a photosensitive drum; the numeral 3 denotes a cleaner; the numeral 4 denotes an electro charger; the numeral 5 denotes a developing unit; the numeral 6 denotes an image transferring unit; the numeral 7 denotes a discharger; the numeral 8 denotes a fixing unit; the numeral 9 denotes sheet-travel path; the numerals 10*a* and 10*b* denote sheet feeders for storing sheet 12 grouped by sizes; and the numeral 11 denotes a stacker. Upon applying a power-supply on, a fixing roller R1 is heated up to a predetermined temperature by a heat lamp 80 installed therein so that the apparatus is ready to print. According to a print instruction, a sheet of instructed size is fed out of sheet feeder 10*a* or 10*b* towards the arrow A direction so as to travel along sheet-travel path 9, and reaches upper surface of photosensitive drum 2. To meet the sheet, photosensitive drum 2 has been electrically discharged by discharger 7, cleaned by cleaner 3 so as to remove residual toner therefrom and electrically charged again by charger 4. A light modulated by the data to be printed is scanned onto photosensitive drum 2 from a laser light source of laser optical unit 1. A latent image formed on the surface of photosensitive drum 2 is exposed with toner which is supplied from toner tank 50 of developing unit 5 and is sticking onto developing roll 51. The developed image is next transferred onto sheet 12*a* by image transferring unit 6. Sheet 12*a* is then transported by being pinched by fixing roller R1 and press roller R2 where the toner is fixed thereon by the heat and the pressure, so as to exit. The toner has been mixed in advance with magnetic powder, and electrically charged by being stirred therewith.

Figure 3:
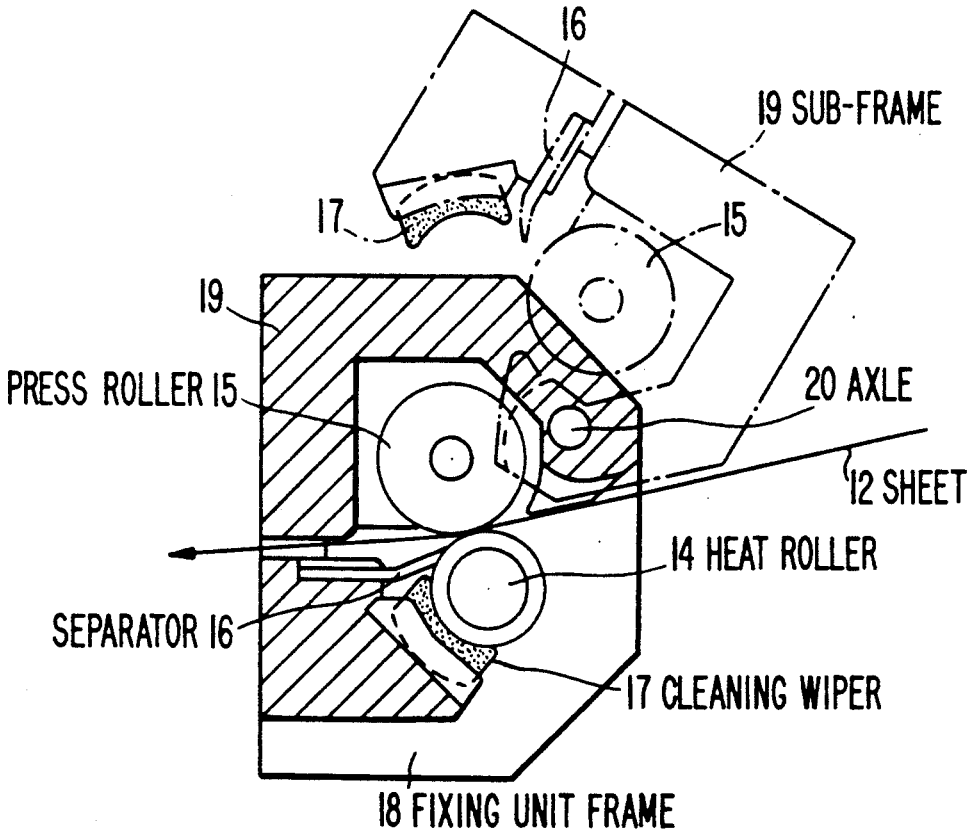

In FIG. 3 the concept of the present invention is illustrated, where solid lines indicate a close state of the fixing unit as well as chain lines indicate an opened state thereof. A press roller 15, a separator 16 and a cleaning wiper 17 are all installed on a sub-frame 19 which is hinged by an axle 20 to a fixing unit frame 18, on which a heat roller, i.e. a fixing roller, 14 is installed. Axle 20 is parallel to the axis of heat roller 14. When sub-frame 19 is closed as an normal operating state, press roller 15, separator 16 and cleaning wiper 17 respectively contact heat roller 14 which has been heated up to a predetermined temperature, as shown with solid lines. A sheet 12, typically of paper, having a toner image thereon is fed into between heat roller 14 and press roller 15, where the toner is fixed onto sheet 12 by being melted by the heat of heat roller 14 and co-pressed by the two rollers. The toner which is on the heat roller side of sheet 12 is apt to stick to the heat roller surface. Accordingly, sheet 12 sticks to heat roller 14. Cleaning wiper 17 wipes off toner remaining on the heat roller surface.

Separator 16 tightly contacting the surface of heat roller 14 is to peel off the sticking sheet from the heat roller surface. However, some sheets may not be peeled off by separator 16 and goes further into under separator 16 and under cleaning wiper 17, resulting in so-called jamming. Then, in order to take out thus jammed sheet, sub-frame 19 is opened by being rotated around axle 20 so that press roller 15, separator 16 and cleaning wiper 17 are released all together from contacting heat roller 14 as shown with dotted lines. In thus-opened state, the jammed sheet can be easily taken out by operator's fingers because the jammed sheet is exposed to thus-provided sufficiently wide space and the sheet is merely sticking to heat roller without being pinched by separator 16 or cleaning wiper 17. Moreover, the easy sheet-removal operation prevents the operator's fingers from being burnt by touching the hot heat roller. Separator 16 being not involved in the sheet-removal operation is never broken. It is preferable that axle 20 being located farther from an axis of heat roller 14 than from an axis of press roller 15 provides more space when the fixing unit is opened than fixing unit having the axle located closer to the heat roller than to the press roller.

Figure 4:
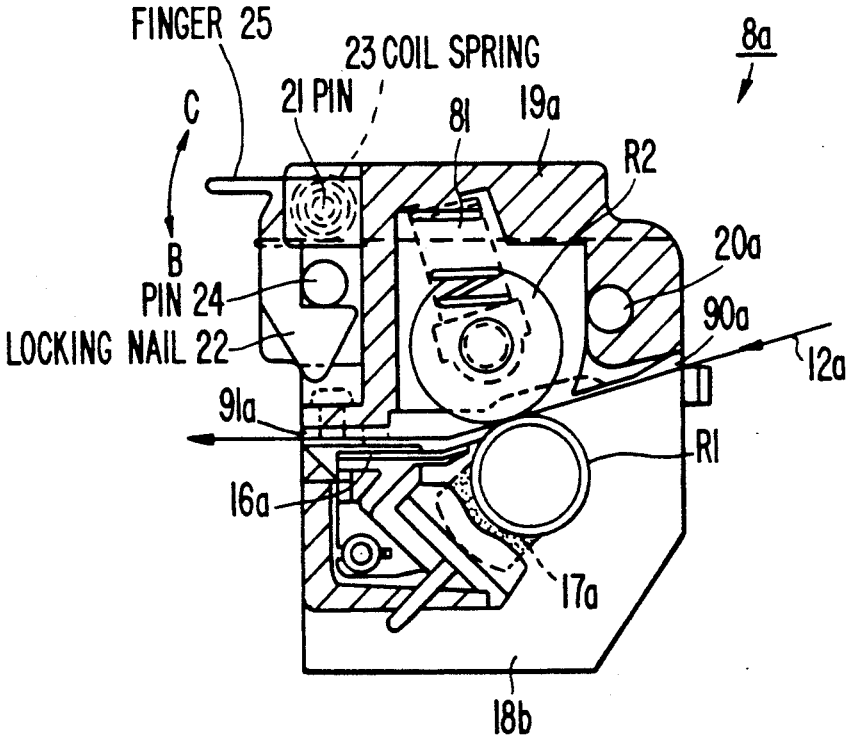
Figure 5:
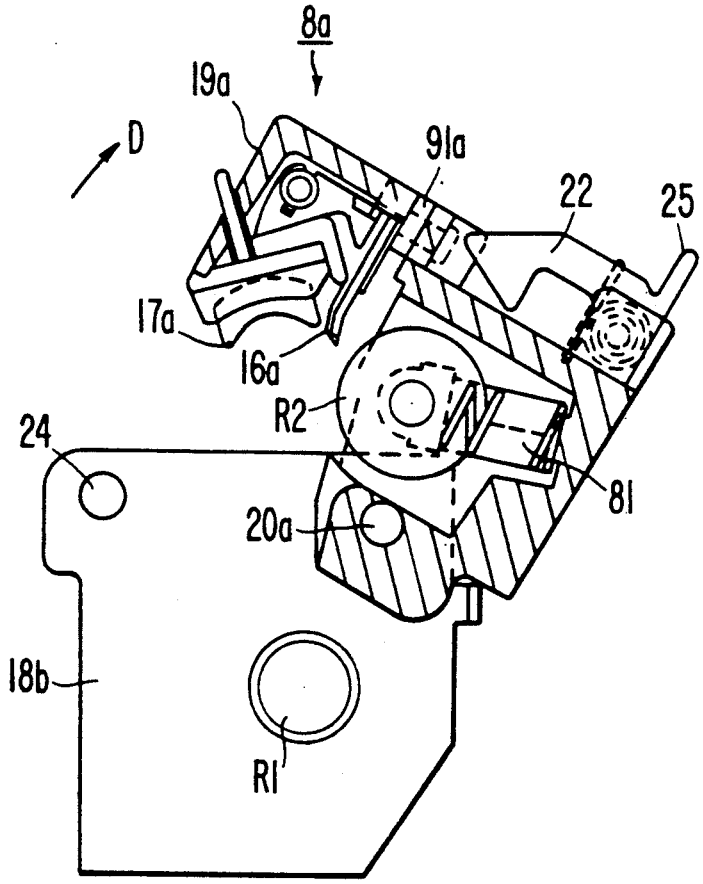

In FIGS. 4 and 5 cross-sectional views of a fixing unit 8*a* of the present invention embodied in the FIG. 2 electro-photographic printing apparatus are schematically illustrated, where FIG. 4 shows a closed state and FIG. 5 shows an opened state. Throughout the figures, the same or corresponding parts are denoted by same or like numerals. Sheet to record thereon 12*a*, heat roller R1, press roller R2 and fixing unit frame 18 correspond respectively to sheet 12, heat roller 14, press roller 15 and fixing unit frame 18 of FIG. 3. A heat roller R1 is installed on a fixing unit frame 18*b* which is fixed to a main frame of the apparatus. Onto sub-frame 19*a* there are installed a press roller R2 via a coil spring 81, a separator 16*a* and a cleaning wiper 17*a*. Sub-frame 19*a* is hinged to fixing unit frame 18*a* by an axle 20*a*. Separator 16*a* typically formed of a plastic plate is provided with a sharp edge tangentially contacting the heat roller surface with a proper pressure generated from the flexibility of the plate so that the sharp edge can squeeze itself into between heat roller R1 and the sheet coming out from between the two rollers. Another end, opposite from the sharp edge, is fixed to sub-frame 19*a*. Cleaning wiper 17*a* typically formed of felt is supported via a felt case 26 by sub-frame so that the felt contacts the heat roller surface with a proper pressure given from a leaf spring which is not shown in the figure. Sub-frame 19*a* is also provided with a locking nail 22 hinged to sub-frame 19*a* by a pin 21 at upper left of the FIG. 4 case. Locking nail 22 is pressed to rotate towards arrow B direction by a coil spring 23 wound around pin 21 so that the locking nail is engaged with fixing unit frame 18*b* via a locking pin 24 when sub-frame 18*b* is closed. The lock can be released by pressing a finger 25 which is unified with locking nail 22 towards arrow C direction, opposite to the arrow B direction, so as to open sub-frame 19*a*, as shown in FIG. 5 sheet 12*a* to fixing unit 8*a* is formed with a gap 90*a* between fixing unit frame 18*b* and sub-frame 19*a*. An outlet of sheet 12*a* from fixing unit 8*a* is formed with a slot 91*a* provided on sub-frame 19*a*.

Though in the above preferred embodiment there is referred to that fixing unit frame 18*b* is fixed to the main frame of the apparatus, the fixing unit frame may be provided so as to be detachable, together with the sub-frame, from the main frame of the apparatus.

The many features and advantages of the invention are apparent from the detailed specification and thus, it is intended by the appended claims to cover all such features and advantages of the methods which fall within the true spirit and scope of the invention. Further, since numerous modifications and changes will readily occur to those skilled in the art, it is not detailed to limit the invention and accordingly, all suitable modifications are equivalents may be resorted to, falling within the scope of the invention.

What I claim is:

1. An electro-photographic printing apparatus comprising a fixing unit for fixing a toner image on a sheet, said fixing unit comprising:

a heat roller installed on a frame, for fixing the toner image on the sheet;

a pressure roller for pinching the sheet with said heat roller;

a separator contacting said heat roller, for separating the sheet from said heat roller;

a cleaning wiper contacting said heat roller, for cleaning said heat roller; and a sub-frame carrying said pressure roller, said separator and said cleaning wiper, said sub-frame being rotatable around an axle installed on said frame, said axle being parallel to said heat roller, wherein said pressure roller, said separator and said cleaning wiper are released all together from said heat roller when said sub-frame is rotated.

2. An electro-photographic printing apparatus as recited in claim 1, wherein said axle is located farther from an axis of said heat roller than from an axis of said pressure roller.

* * * * *